US005655222A

United States Patent [19]

Grilliot et al.

[11] Patent Number: 5,655,222

[45] Date of Patent: Aug. 12, 1997

[54] FIREFIGHTER'S GARMENT HAVING INSPECTION PORTS

[75] Inventors: William L. Grilliot; Mary I. Grilliot, both of Dayton, Ohio

[73] Assignee: Morning Pride Manufacturing, Inc., Dayton, Ohio

[21] Appl. No.: 323,772

[22] Filed: Oct. 17, 1994

[51] Int. Cl.[6] ..... A41D 13/00

[52] U.S. Cl. ..... 2/81; 2/97; 2/272

[58] Field of Search ..... 2/69, 79, 81, 85, 2/86, 93, 97, 272, 243.1, 247, 227

[56] References Cited

U.S. PATENT DOCUMENTS

| | | | |
|---|---|---|---|
| 3,710,395 | 1/1973 | Spano et al. | 2/81 |
| 5,010,592 | 4/1991 | Skiles, Jr. | 2/93 |
| 5,090,058 | 2/1992 | Gerber | 2/97 |
| 5,136,723 | 8/1992 | Aldridge et al. | 2/81 |

*Primary Examiner*—Diana Biefeld

*Attorney, Agent, or Firm*—Dressler, Rockey, Milnamow & Katz, Ltd.

[57] ABSTRACT

The firefighter's garment of the invention comprises an inner liner attached to and located within an outer shell of abrasion resistant material. The inner liner consists of a layer of a thermally insulating material attached to a layer of moisture resistant material along a plurality of seams that extend around the periphery of the liner such that the area enclosed by the layers is completely enclosed. A plurality of releasable fasteners are positioned at desired locations in the garment, preferably in the seams, to allow the firefighter to visually inspect the area enclosed by the moisture resistant layer and the thermally insulating layer.

11 Claims, 4 Drawing Sheets

FIREFIGHTER'S GARMENT HAVING INSPECTION PORTS

BACKGROUND OF THE INVENTION

The present invention generally relates to firefighting garments and, more particularly, to improved firefighting garments having inspection ports for checking the integrity of the constituent components of the inner liner used in such garments.

Typically, firefighter's garments include an outer layer made of an abrasion and flame resistant material such as high temperature aramid, nylon or the like. An intermediate or moisture barrier is positioned beneath the outer shell and comprises a layer of any suitable moisture impermeable material such as neoprene foam or polytetrafluoroethylene that is bonded to a base fabric. An inner layer or thermal insulation layer made of aramid or other suitable thermally insulating material typically is attached to and located inside the moisture barrier.

The moisture barrier and thermally insulating layers typically are sewn together to create an inner liner such that the layer of moisture impermeable material is enclosed by the base fabric and the thermal insulation layer. It should be noted that some of the characteristics of these barriers can be combined in a single layer. For example, a single layer of material could have the abrasion and flame resistant properties of the outer shell and the moisture resistant properties of the moisture barrier.

Firefighter's garments, such as those discussed above, are subject to extreme thermal stress and wear when used by a firefighter in the course of fighting a fire. It is important that the integrity of the moisture barrier and thermal insulation layer of a firefighter's garment be maintained to optimally protect the firefighter. For example, a breach in the moisture barrier allows moisture and/or hot vapors to enter the garment thereby increasing the stress on the firefighter and increasing the likelihood of burns.

A firefighter cannot visually inspect the integrity of the inner liner in prior art garments because the constituent layers of materials in the liner are sewn together. Also, the layer of moisture impermeable material enclosed by the base fabric and the thermal insulation layer may be damaged precluding its moisture resistant properties without any indication of that damage being present on the exposed base fabric of the moisture barrier.

Accordingly, an improved firefighter's garment is desired that allows a firefighter to quickly and easily inspect the interior of the inner liner to determine if there are any defects in the moisture barrier or the thermally insulating layer.

SUMMARY OF THE INVENTION

The firefighter's garment of the invention comprises an inner liner attached to and located within an outer shell of abrasion and flame resistant material. Preferably, the inner liner is releasably secured inside the outer shell by a plurality of fasteners such as snaps, hook and loop fasteners, buttons or other suitable means. The inner liner may, however, be permanently fixed within the outer shell. The inner liner consists of a layer of a thermally insulating material sewn to a layer of moisture resistant material along a plurality of seams that extend about the periphery of the liner.

At least one inspection port closed by a releasable fastener can be positioned at any desired location in the garment to allow the firefighter to visually inspect the integrity of the inner liner by temporarily releasing the fastener. Preferably, three inspection ports are positioned in the seams of the garment and each releasible fastener comprises a hook and loop fastener sold under the trademark VELCRO, although snaps or buttons could be used if desired. If the firefighter discovers that the inner liner is significantly damaged, then the damaged liner can be removed and replaced.

DETAILED DESCRIPTION OF THE INVENTION

Figure 1:
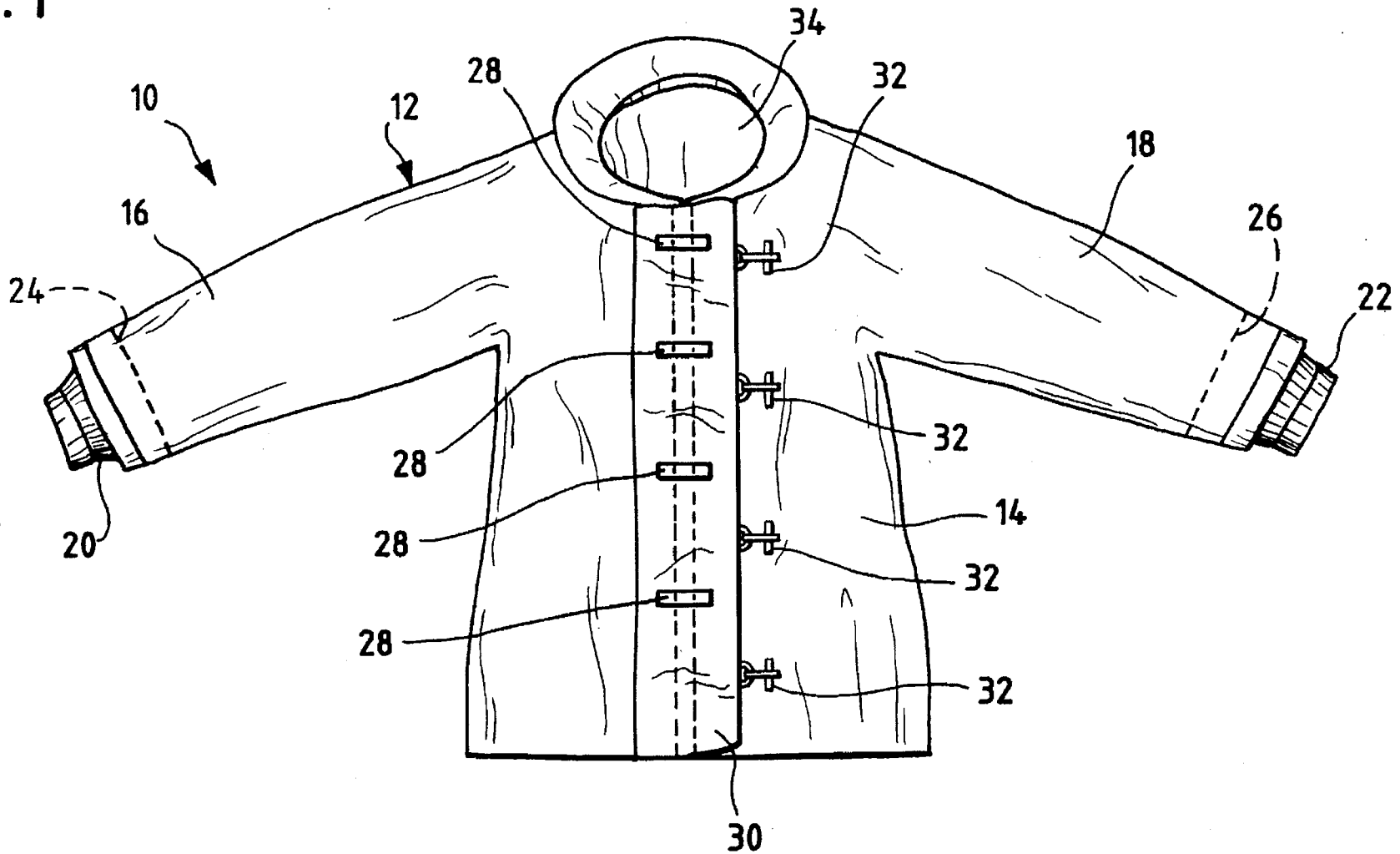
FIG. 1 shows a front view of a firefighter's garment using the improved liner of the invention.

Referring to FIG. 1, the firefighter's garment 10 of the invention is shown consisting of an outer shell 12 having a body portion 14 and two sleeve portions 16 and 18. The outer shell consists of a material having flame resistant and abrasion resistant characteristics suitable for use as a firefighter's garment. A preferred material for outer shell 12 is aramid, although other suitable materials could be used. While the invention is discussed with reference to the coat of FIG. 1, it must be noted that it can be practiced in other firefighter's garments such as overpants.

The front of body portion 14 of outer shell 12 includes two side portions joined together by a plurality of fasteners 28. Flap 30 is attached to one of the sides of body portion 14, covers fasteners 28 and is secured to the other side of body portion 14 by fasteners 32. Preferably, fasteners 28 and 32 are snaps although any suitable fastener such as buttons can be used, provided they securely attach the sides of body portion 14 together and flap 30 to body portion 14.

Figure 2:
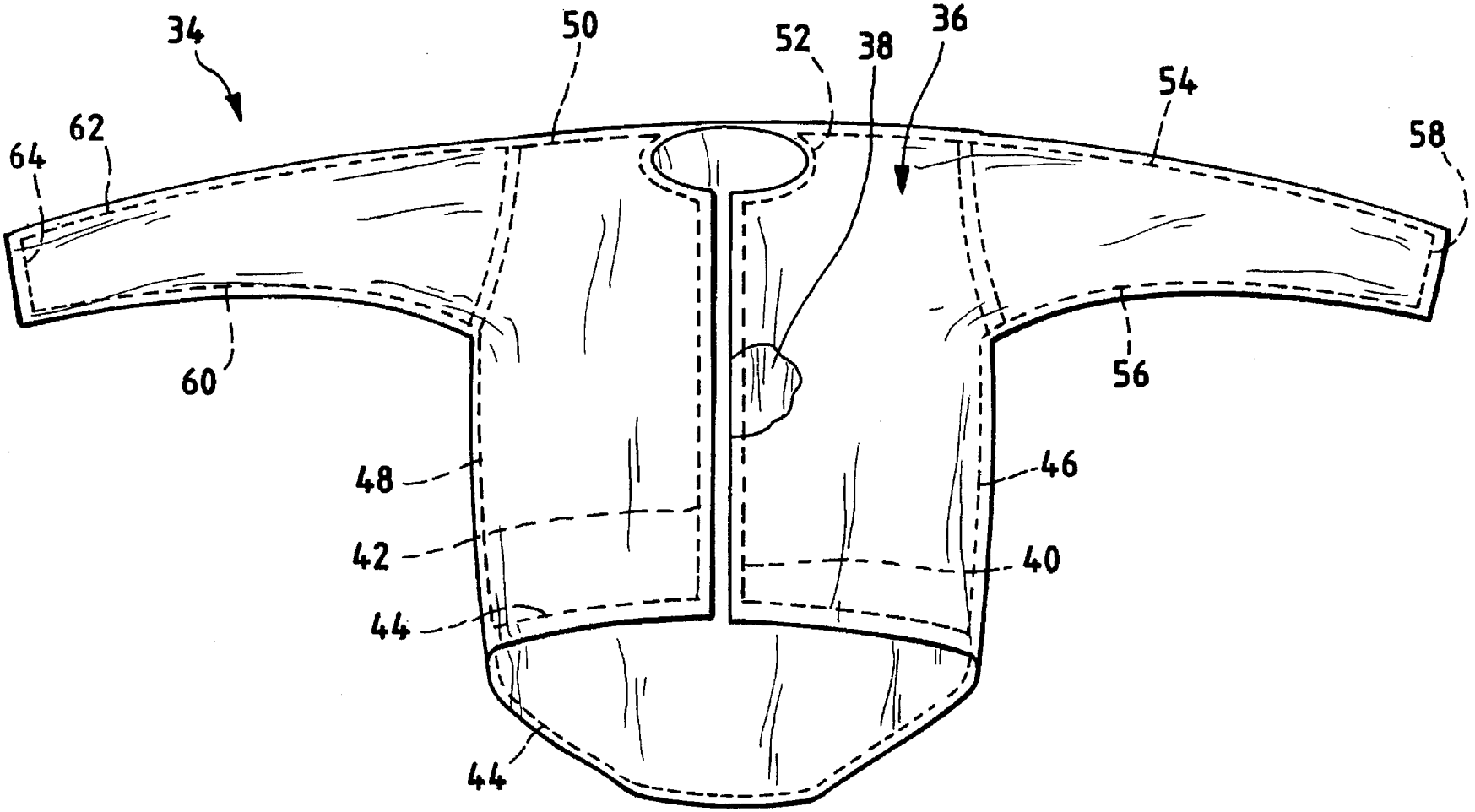
FIG. 2 shows a front view of the inner liner that is located inside the garment shown in FIG. 1.

FIG. 2 shows a front view of an inner liner 34 that is located inside of outer shell 12. Preferably, inner liner 34 is substantially coextensive with the outer shell 12 and is releasably attached to the inside of outer shell 12 by a plurality of fasteners (not shown), as well known in this art. Alternatively, inner liner 34 can be permanently attached inside of outer shell 12. The fasteners used to attached inner liner 34 to outer shell 12 are spaced about the periphery of the body and sleeve portions 14 and 16 of garment 10 and are snaps, although any suitable fastener can be used provided they securely attach inner liner 34 to outer shell 12.

Inner liner 34 consists of a moisture resistant layer or moisture barrier 36 attached to an inner layer of thermally insulating material 38 along a plurality of seams (dashed lines in FIG. 2). Preferably, moisture resistant layer 36 is constructed of a layer of a moisture impermeable material such as polytetrafluoroethylene or neoprene that is bonded to a base fabric, although other suitable materials could be used. Layers 36 and 38 are preferably sewn together at seams 40–64 that extend about the periphery of the liner such that the area between the thermal layer and the moisture barrier and the layer of moisture impermeable material is completely enclosed.

Figure 3:
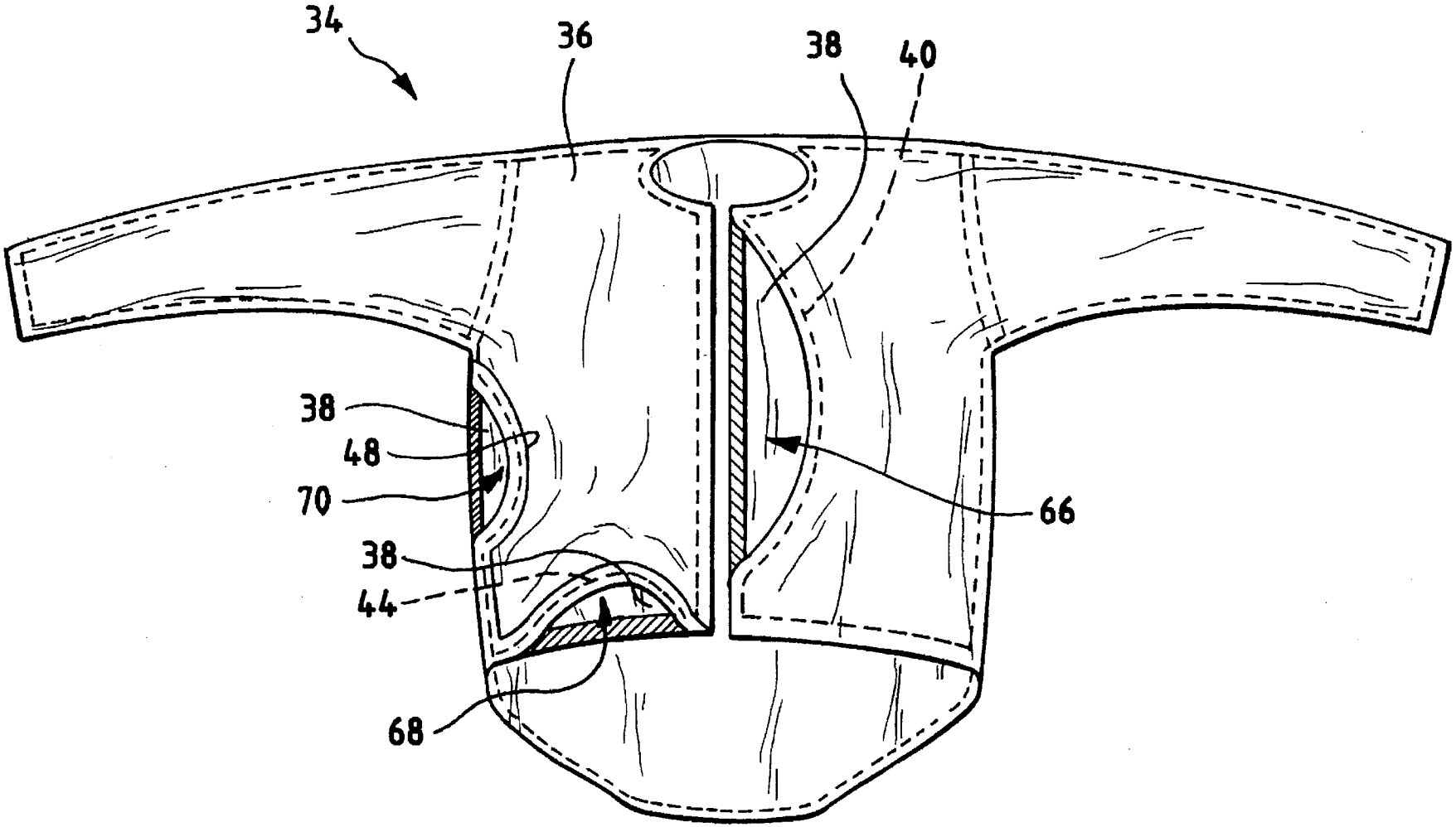
FIG. 3 shows a front view of the inner liner of FIG. 2 having three opened inspection ports.

FIG. 3 illustrates three inspection ports 66, 68 and 70 incorporated in front seam 40, hem seam 44 and side seam 48. Although FIG. 3 shows three inspection ports in inner liner 34, it must be noted that any number of inspection ports can be utilized and that the ports can be positioned anywhere in liner 34. Preferably, three inspection ports are positioned at desired locations in seams 40–64 as shown in FIG. 3 to allow a firefighter to fully inspect the entirety of the area enclosed by the layers 36 and 38.

Figure 4:
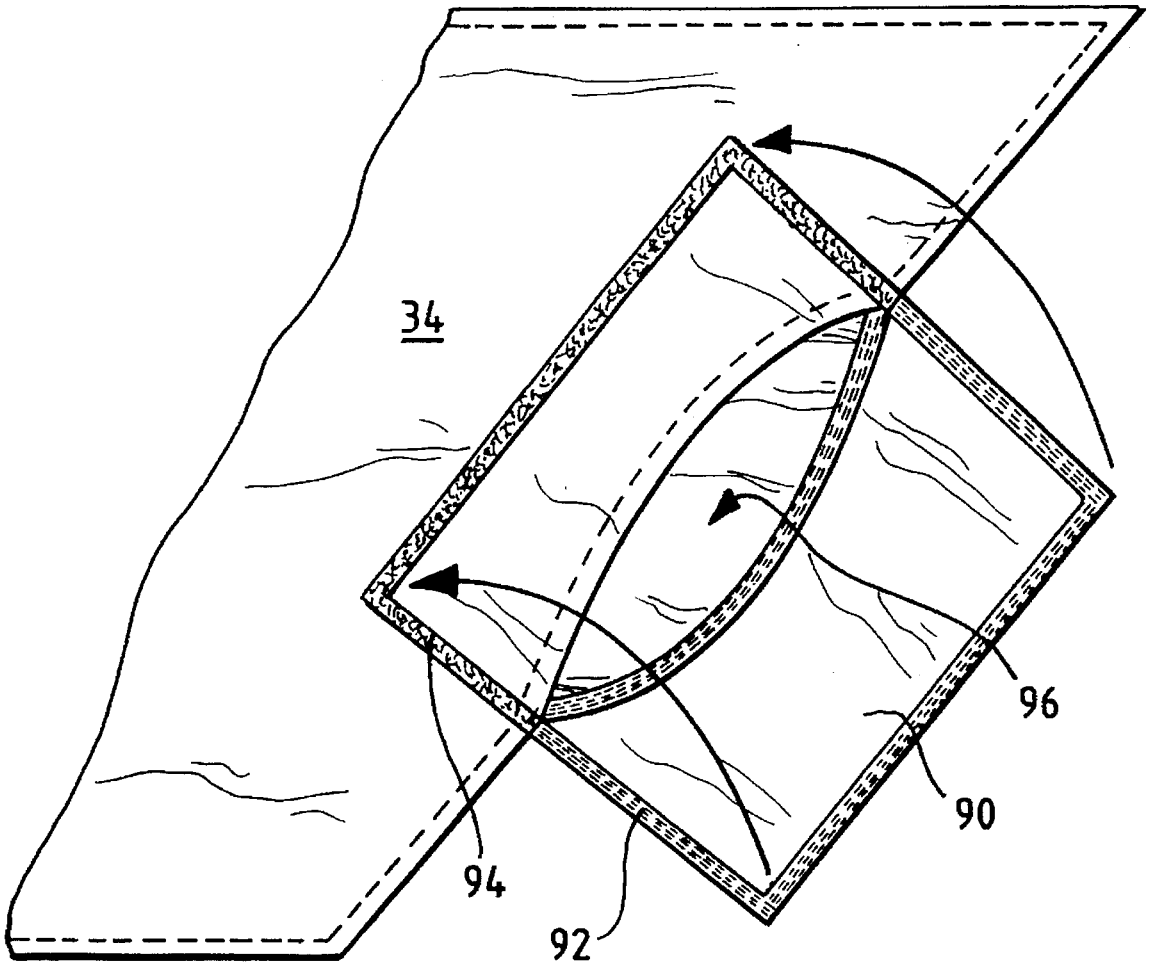
FIG. 4 shows a front view of an inspection port that is sealed by a waterproof flap.

While the inspection ports are preferably located along a seam, it is to be understood that they can be located elsewhere on inner liner 34. When the inspection port is not located along a seam, a sealing flap or other suitable means such as removable tape is used to waterproof the inspection port as best shown in FIG. 4. FIG. 4 shows that a sealing flap 90 can be connected to inner liner 34 by, for example, hook and loop fasteners 92 and 94 thereby to seal inspection port 96. While such a sealing means is not required for ports arranged along a seam, it can be used, if desired, to create a more secure seal.

Each inspection port comprises an elongated releasable fastener that is positioned at a desired location in garment 10. These fasteners preferably are strips of hook and loop fasteners, such as-those sold under the trademark VELCRO, although other suitable fasteners could be used such as buttons or snaps. For example, inspection port 66 comprises a strip of hooks attached to thermal liner 38 beneath a strip of loop fasteners attached to moisture barrier 36. The hook and loop fasteners preferably are secured to their corresponding layers of materials by adhesives, stitching or other suitable attachment mechanisms.

The use of the firefighter's garment of the invention will now be described. To optimally protect a firefighter, the garment must be in good, working order and must not contain any rips, punctures, abrasions or the like. Thus, a firefighter routinely performs checks to verify the garment's integrity. The inner liner of the invention allows a firefighter to visually inspect the area enclosed by moisture resistant layer 36 and thermal insulation layer 38 simply by separating the hook fasteners from the loop fasteners at the desired inspection ports. If it is determined that the inner liner is in poor condition, then it can easily be replaced. If the inner liner 34 is permanently attached to shell 12, garment 10 can be discarded or a new liner can be installed.

While the invention was described in some detail with respect to the drawings, it will be appreciated that numerous changes in the details and construction of the garment can be made without departing from the spirit and scope of the invention.

What is claimed is:

1. A firefighter's garment comprising an outer shell and an inner liner attached to and located within said outer shell, said liner comprising:

a) a first layer;

b) a second layer attached to said first layer along a plurality of seams that extend about the periphery of the liner such that the area between the first layer and the second layer is substantially enclosed; and c) at least one inspection port positioned in the inner liner at a location in which the area between said first layer and said second layer is not enclosed, wherein each of said at least one inspection port includes a releasable fastener for allowing each said at least one inspection port to be selectively opened and closed to allow for visual inspection of the area between the first and second layers.

2. The firefighter's garment of claim 1, wherein each releasable fastener comprises a strip of hooks attached to one of said first and second layers and a strip of loops attached to the other of said first and second layers.

3. The firefighter's garment of claim 1 further comprising a sealing flap for waterproofing each of at least one inspection port.

4. The firefighter's garment of claim 1, wherein said outer shell consists of a material having flame and abrasion resistant properties, said first layer consists of a moisture resistant material and said second layer consists of a thermally insulating material.

5. The firefighter's garment of claim 1, wherein said at least one inspection port is positioned at one of said seams.

6. The firefighter's garment of claim 1, wherein said inner liner is substantially coextensive with the outer shell and is releasably attached to said outer shell by a plurality of fasteners.

7. An inner liner for use with a firefighter's garment including an outer shell having abrasion resistant and flame resistant properties, said inner liner comprising:

a) a layer of thermally insulating material;

b) a layer of moisture resistant material attached to said thermally insulating layer along a plurality of seams that extend about the periphery of the liner such that the area between the thermally insulating layer and the moisture resistant layer is substantially enclosed; and c) at least one inspection port positioned in the inner liner at a location in which the area between said thermally insulating layer and said moisture resistant layer is not enclosed, wherein each of said at least one inspection port includes a releasable fastener for allowing each said at least one inspection port to be selectively opened and closed to allow for visual inspection of the area between the layers of thermally insulating material and moisture resistant material.

8. The inner liner of claim 7, wherein each releasable fastener comprises a strip of hooks attached to one of said moisture resistant and thermally insulating layers and a strip of loops attached to the other of said moisture resistant and thermally insulating layers.

9. The inner liner of claim 7 further comprising a sealing flap for waterproofing each of said at least one inspection port.

10. The inner liner of claim 7, wherein said at least one inspection port is positioned at one of said seams.

11. The firefighter's garment of claim 7, wherein said inner liner is substantially coextensive with the outer shell and is releasably attached to said outer shell by a plurality of fasteners.

* * * * *